US005278562A

United States Patent [19]

Martin et al.

[11] Patent Number: 5,278,562

[45] Date of Patent: Jan. 11, 1994

[54] METHOD AND APPARATUS USING PHOTORESISTIVE MATERIALS AS SWITCHABLE EMI BARRIERS AND SHIELDING

[75] Inventors: Michael T. Martin, Lakeside; Michael L. Duhl, San Diego, both of Calif.

[73] Assignee: Hughes Missile Systems Company, Los Angeles, Calif.

[21] Appl. No.: 927,703

[22] Filed: Aug. 7, 1992

[51] Int. Cl.[5] ..... H01Q 17/00

[52] U.S. Cl. ..... 342/1; 343/872; 343/841; 343/873; 343/700 MS

[58] Field of Search ..... 342/1, 2, 4; 343/872, 343/705, 841, 873, 700 MS, 911.R, 912, 913

[56] References Cited

U.S. PATENT DOCUMENTS

| | | | |
|---|---|---|---|
| 3,955,201 | 5/1976 | Crump | 343/872 |
| 4,932,755 | 6/1990 | Holdridge et al. | 350/321 |
| 4,977,329 | 12/1990 | Eckhardt et al. | 250/551 |

*Primary Examiner*—Mark Hellner

*Attorney, Agent, or Firm*—Randall M. Heald; Charles D. Brown; Wanda K. Denson-Low

[57] ABSTRACT

A method and apparatus for providing a switchable electromagnetic interference (EMI) barrier. The method protects an object against electromagnetic radiation, through the steps of: providing an object to be protected from electromagnetic radiation; placing a barrier sheet adjacent to the object, the sheet being opaque to radiatiôn when exposed to light; directing the light against the sheet when a barrier to the radiation is desired; and extinguishing the light when passage of the radiation through the sheet is desired. One embodiment is a switchable electromagnetic radiation barrier system that includes a photoresistive sheet interposed between a source of electromagnetic radiation and an object to be protected from the radiation. This sheet is opaque to the radiation when exposed to light of a selected visible intensity range. A light source adjacent to this sheet directs the light against the sheet. A second embodiment is an apparatus for protecting an EMI-sensitive device in an air vehicle from external electromagnetic radiation (EMR). The apparatus includes: a cavity in an air vehicle; an EMI-sensitive device in the cavity; and a barrier window covering the cavity. The window includes a support sheet having a layer of photoresistive material. This material transmits EMR when exposed to light and does not transmit EMR when unlighted. A light source is provided to selectively illuminate the layer. Another embodiment is an antenna element of layered sandwich construction, including a polyimide film layer. Switchable means are used in the embodiments to turn the light source off and on.

18 Claims, 3 Drawing Sheets

METHOD AND APPARATUS USING PHOTORESISTIVE MATERIALS AS SWITCHABLE EMI BARRIERS AND SHIELDING

BACKGROUND

This invention relates to novel improvements and use in a method and apparatus for using photoresistive materials, and more particularly, but not by way of limitation, to provide a switchable electromagnetic interference (EMI) barrier.

Electrical circuitry often must be protected from disruptions caused by EMI entering the system. External EMI energy is an undesired conducted or radiated electrical disturbance that can interfere with the operation of electric equipment. EMI interference describes redistribution of energy in space or time because of reinforcement and cancellation of parts of the disturbance. When the same frequencies are in proximity to each other, exact reinforcement or complete cancellation can occur depending on the phasing of the waves. Slightly different frequencies interfere to produce beats, alternate reinforcements and cancellation that are periodic with time.

Interference is the process whereby two or more waves of the same frequency or wavelength combine to form a wave whose amplitude is the sum of the amplitudes of the interfering waves. If the two waves are of equal amplitude, they can cancel each other out so the resulting amplitude is zero. In optics, this cancellation can occur for particular wavelengths in a situation where white light is a source. The resulting light will appear colored. This phenomenon gives rise to the iridescent colors of beetles' wings and mother-of-pearl, where the substances involved are actually colorless or transparent. Many methods exist using mirrors or prisms to illustrate the interference that can result from different frequencies.

With the development of nuclear explosives, another type of electromagnetic radiation has been observed. Nuclear explosion, and in some circumstances large scale chemical explosions, produce a sharp pulse (large impulse type) of radio frequency (long wave length) electromagnetic radiation. The intense electrical and magnetic fields created by electromagnetic pulse (EMP) energy can damage unprotected electrical and electronic equipment over a wide area. As a result, a demand has appeared for materials that can provide sufficient, or substantial shielding effectiveness against EMP energy threats.

"Smart" materials can be classified as materials that react or take an action to an external stimulus to provide a useful result. Cadmium Sulfide is a well known photoresistor used in lamps and light fixtures around homes and businesses to turn lights on automatically after dusk, and then off again at dawn. In the process of performing this function, the material becomes more or less conductive based on the presence or absence of light.

Photoconductive effects, in which the radiation changes the electrical conductivity of the material upon which it is incident, have been known for many years. There are two types of photoconduction extrinsic and intrinsic. In the intrinsic case, the photoconduction is produced by absorption of light to create a band-to-band transition across the bandgap, where the absorption coefficient is very large because of the large number of available electron states associated with the conduction and valence bands. With the advance of microfabrication technology, photoconductive switches of various configurations have been fabricated in different materials. The addition of light photons to a cadmium sulfide compound results in the freeing up of free electrons which are able to conduct current. As the material becomes more conductive, the inherent ability to block RF energy becomes apparent.

An optical interferometer is based on both two-beam interference and multiple-beam interference of light. Typically these phenomena are extremely powerful tools for metrology and spectroscopy and a wide variety of measurements can be performed. Other types of interferometers exist. Two basic classes exist: division of wavefront and division of amplitude.

Radar-absorbing materials are designed to reduce the reflection of electromagnetic radiation by a conducting surface in the frequency range from approximately 100 MHz to 100 GHz. The level of reduction achieved varies from a few decibels to greater than 50 dB, in percentage terms reducing the reflected energy by up to 99.999%. The performance of any material as a microwave absorber can be calculated from Maxwell's equations if the electrical and magnetic properties are known. However, in the most simple terms, two conditions are necessary to produce absorption. First, the characteristic impedance of the material must match the characteristic impedance of free space so that the electromagnetic energy may enter the material. Second, the material must then attenuate the electromagnetic radiation, which means that it must exhibit either dielectric or magnetic loss, or both.

Microwave-absorbing materials are widely used both within the electronics industry and for defense purposes. Their uses can be classified into three major areas: (1) for test purposes so that accurate measurements can be made on microwave equipment unaffected by spurious reflected signals, such as the anechoic chamber; (2) to improve the performance of any practical microwave system by removing unwanted reflections which can occur if there is any conducting material in the radiation path, and (3) to camouflage a military target by reducing the reflected radar signal.

Despite the theoretical possibility of absorption, in practice, materials have not been found which will give a good impedance match over an appreciable frequency range. It is therefor necessary to adopt specific design methods to manufacture practical absorbing materials.

Two methods have been widely adopted in order to produce such absorbers. The first is to avoid a discrete change of impedance at the material surface by gradually varying the impedance. For example, a thick profiled lossy layer could be used. The removal of the discrete discontinuity at the surface allows the microwave energy to be transmitted into the absorbing medium without reflection. Tapering of the material over distances which are large compared with the wavelength provide this absorption characteristic. Practical absorbers giving greater than 20 dB absorption vary in thickness from about 0.8 inches (2 cm) at 10 GHz and above to six feet (2 m) at 100 MHz and above.

A second technique provides for much thinner absorption layers. These materials consist of lossy layers where the absorption is produced by a destructive interference at the frequency for which the material is electrically a quarter wavelength. The performance is a function of the wavelength frequency, and is tunable from 100 MHz to 100 GHz. In addition to providing a relatively narrow bandwidth frequency performance, it is possible to broaden the bandwidth through a technique of multiple layer absorbers. With two layers of material it is possible to tune one absorber to two different frequencies. By placing these two frequencies appropriately, such as within one octave of each other, a broadband absorber is obtained.

Prior art has shown developments in use of apparatus in the form of seals as one way of providing the necessary shielding. Electrical connectors are illustrated in COOPER et al U.S. Pat. No. 4,330,166, and static housing or gasket seals for equipment cabinets, as illustrated in KEELER U.S. Pat. No. 4,061,413. NEHER U.S. Pat. No. 4,807,891 describes a resilient metal bellows surrounding a static electromagnetic pulse rotary seal.

Existing apparatus and methods only partially solve the problems overcome by the present invention. Finally, current known technology has different purposes than the present invention, not just different applications. One difficulty with the mentioned prior art is that NEHER is applicable to parts moving in relation to each other, whereas the present invention involves static parts. In addition, the other prior art also does not provide for permitting electromagnetic radiation to pass through when required. The connectors or seals are only designed to prevent the transmittal of radiation.

SUMMARY OF THE INVENTION

Briefly stated, the present invention provides a novel method and apparatus for providing a switchable EMI barrier.

The method protects an object against electromagnetic radiation, through the steps of: providing an object to be protected from electromagnetic radiation; placing a barrier sheet adjacent to the object, the sheet being opaque to radiation when exposed to light; directing the light against the sheet when a barrier to radiation is desired; and extinguishing the light when passage of radiation through the sheet is desired.

A first embodiment is a switchable electromagnetic radiation barrier system, includes a photoresistive sheet interposed between a source of electromagnetic radiation and an object to be protected from radiation. This sheet is opaque to radiation when exposed to light of a selected visible intensity range. A light source in the approximate vicinity to this sheet directs the light against the sheet. Also, switching means are used for turning the light source off and on.

A second embodiment is an apparatus for protecting an EMI-sensitive device in an air vehicle from external EMR. The apparatus includes: a cavity in an air vehicle, an EMI-sensitive device in the cavity; and a barrier window covering the cavity. The window includes a support sheet, having a layer of photoresistive material. This material transmits EMR when exposed to light and does not transmit EMR when unlighted. A light source is provided to selectively illuminate the layer. Switchable means are also used to turn the light source off and on.

Still another embodiment is an antenna of layered sandwich construction having a photoresistive material as a switchable EMI barrier. This antenna includes: a thin film electro-illuminescent solid state lamp, as a photon source, and antenna ground plane layer, a transparent dielectric sandwich layer, a polyimide film layer with photoresistive material coating, a polyurethane topcoat layer, and a protective $SiO_2$ coating layer.

Smart materials or materials that react to or change performance based upon the given threat scenario, are the next logical step in the development of advanced radar absorbing material/radar absorbing structure (RAM/RAS) products, such as a new generation of vehicle designs to include a new class of microwave absorbers. These new smart materials can be used for improved manufacturability.

The phenomenon of a photoresistive material becoming more conductive and able to block RF energy was used in a unique way and produced unexpected and successful results by using photoresistive films as a switchable EMI barrier, and shielding from radio frequencies.

A microwave interferometer was used in testing to demonstrate and verify the concept of the present invention in the signature technology RAM/RAS lab. A microwave interferometer is an instrument for precise determination of material permittivity and permeability by measuring the response of the material to radiated microwave energy and gathering the magnitude and phase information of the reflected and transmitted energy. The relative semiconducting state of the photoresistive material is controlled by the photo illumination level and light frequency. The conductive nature of these materials when illuminated provides an effective EMI barrier.

Applications include shielding of sensitive equipment from EMI when not in use, and then switching the material off to allow operation of the equipment. Applications include shielding of microwave energy from the use of a microwave oven door, activated by the interior light of the oven. Other applications include shielding of microwave energy from dual sources sharing a common reflector or combination of reflectors.

The concept was tested using Cadmium Sulfide (CdS) as the photoresistive material. Other materials are available for use in this invention, such as Tellurium Sulfide (TeS), Tellurium Selenide (TeSe), and Lead Indium (PbIn). We limited our demonstration efforts to only one type.

The following listing shows several other semiconductor materials and their photoconductivity as a function of light wavelength in microns. Depending on the application required, one or more of these materials could also be used as a coating. The choice is not limited to CdS.

| Material | Wavelength (microns) |
|---|---|
| Zinc Sulfide (ZnS) (pure) | 0.338 |
| ZnS (Cu doped) | 0.540 |
| Zinc Selenide (ZnSe) (pure) | 0.465 |
| ZnSe (Cu doped) | 0.515 |
| Zinc Telluride (ZnTe) (doped) | 0.800 |
| Cadmium Sulfide (CdS) (pure) | 0.520 |
| CdS (Cu doped) | 0.620 |
| CdS (Cl doped) | 0.620 |
| Cadmium Selenide (CdSe) (pure) | 0.720 |
| Lead Sulfide (PbS) | 2.900 |
| Lead Selenide (PbSe) | 4.200 |
| Lead Telluride (PbTe) | 4.700 |

Cadmium Sulfide was deposited on one side of a thin layer of polyimide film in four different thicknesses. Kapton TM polyimide was used. The various thickness levels provided different values for conductivity of the films.

Testing was performed in a 2–18 GHz Hewlett-Packard model HP 8510B interferometer using a fluorescent lamp for the light source.

The photoresistive films provide down to about 10±10% ohms per square resistivity. Thicker coating will provide effective EMI barriers of approximately 1 ohm per square. The off-state of the CdS coating provides resistivities of approximately 1500±10% ohms per square or transparent to EMI effects. Analysis and testing have shown that achieving less than 10 ohms/-square resistivity allows the material to function as a shielding barrier.

Thin cadmium sulfide coatings were produced by electron beam-vacuum deposition onto one side of the polyimide film. Several thicknesses of coatings were produced on the thin polyimide substrate of 0.002 inches. The thicknesses were produced by varying the time to deposit these coatings on the substrate. For testing purposes, four coating thicknesses of 68,000 through 2,200 angstroms were fabricated. However, analysis showed that 50,000 to 100,000 angstroms would be preferred for best blocking results. These coatings were then tested in the microwave interferometer from 2–18 GHz in both the presence and absence of light. The light source used was a fluorescent light fixture with two 15 watt bulbs. Cadmium sulfide reacts to light waves from 450 nanomicrons (nm) to 650 nm and peaks its performance at 550 nm which corresponds to the white fluorescent light waves. The coating thickness corresponds to the resistivity of the coating, the thicker the coating the less resistive. Note that the resistivity or ohms/square is calculated for 2–18 GHz based on the S-parameter data collected by the HP 8510B. The coatings cover several orders of magnitude of resistivity in the illuminated (on) and darkened (off) conditions. Using these coatings it is possible to build a switchable radio frequency (RF) window that will also allow infrared (IR) energy to pass through in either the off or on state.

In the embodiments, as well as in the testing, the distance of the light source from the coated film can vary depending on conductivity requirements, the thickness of the coating and film, and the wattage or power of the light source.

A $SiO_2$ thin coating, applied over the CdS or other coating compound with photoresistive properties, will provide protection to the polyimide film from contamination or degradation. Other uses of the material's resistivities include acting as a tapered resistive design.

None of the prior art uses the method and apparatus in the present invention. In the present invention, advantages include the ability to have different values for conductivity based on the photoresistive film thickness used, use as a shield for EMI sensitive equipment, as switchable apertures and antenna covers, plus potential commercial uses.

In one embodiment, a microstrip antenna in a sandwich configuration eliminates sensor cavity frequency interference. In this same sandwich configuration, a frequency selective surface is incorporated into a CdS coating. The conformal antenna configuration is easy to fabricate. And using a solid state device as the light source reduces weight, and increases efficiency.

These and other aspects of the present invention are set forth more completely in the accompanying figures and the following description.

DETAILED DESCRIPTION OF PREFERRED EMBODIMENTS

Figure 1B:
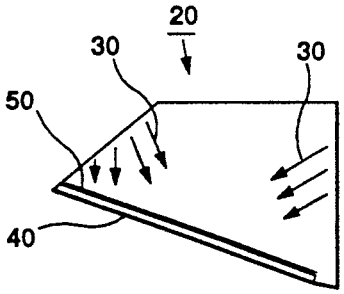
FIG. 1*b* is a detail schematic section view showing of the first embodiment in accordance with the present invention.
Figure 1A:
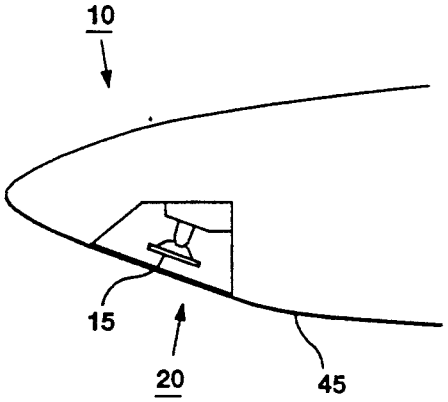
FIG. 1*a* is a schematic section view showing a first embodiment of apparatus for providing a window or aperture in accordance with the present invention.

Referring to FIG. 1*a*, there is seen a sensor installation 10 in an air vehicle nose cone, a sensor 15, a sensor cavity 20, and an outer skin 45. A sensor 15 would be chosen based on design requirements and placed in a space or sensor cavity 20 within a nose cone. The outer skin 45 is that of the vehicle, in this particular embodiment.

Referring to FIG. 1*b*, there is seen a detail schematic section view of sensor cavity 20 in FIG. 1*a*, showing a photon interior illumination 30, an IR/RF sensor aperture or window 40, and a CdS coating 50. The photon interior illumination 30 could be a light source of one or more fluorescent bulbs, and of different wattage, depending on requirements. The illumination 30 would need to be turned on or off depending on the need for transmitting frequencies from the sensor device. So a timing circuit or sensing circuit could be the means for switching the light source on and off. The coating 50 would be applied over the aperture 40 with the selected semiconductor material to achieve the needed resistivity.

Figure 1C:
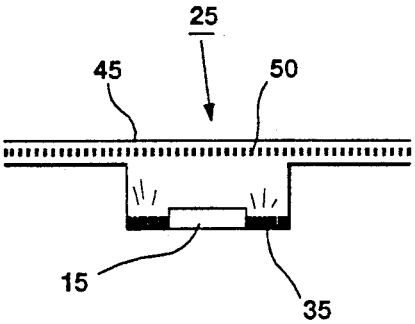
FIG. 1*c* is a more detailed schematic section view showing of FIG. 1*b* and alternative configuration in accordance with the present invention.

Referring to FIG. 1*c*, there is seen a more detailed illustration and alternative configuration based on FIG. 1*a*. The cavity cover assembly 25, comprises a sensor 15, a fluorescent lamp 35, an outer skin 45, and a CdS coating 50. This sensor device 15 could be a transmitting horn, or a sensor in an avionics package, such as found in the vehicle. The lamp 35 could be a light source of one or more fluorescent bulbs, and of different wattage, depending on requirements. The outer skin 45 is identical with that of FIG. 1*a*. And the coating 50 is identical to that described in FIG. 1*b*.

Figure 2:
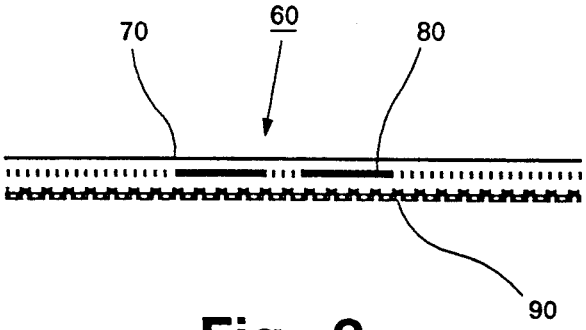
FIG. 2 is a schematic section view showing a second embodiment having a switchable antenna cover using a coating of CdS within the antenna sandwich and incorporating a thin coating electro-illuminescent lamp as the photon source.

Referring to FIG. 2, there is seen a conformal antenna 60, an outer skin 70, a conformal antenna sandwich 80, and an electro-illuminescent lamp 90. The antenna 60 is a different shape or design than those in FIGS. 1*a*, 1*b*, or 1*c*. This antenna 60 is smaller and designed to minimize detection by other radar devices. The skin 70 is similar in purpose to the outer skin 45 of FIG. 1*a* and 1*c*. The conformal antenna sandwich 80 comprises five layers and described in detail in FIG. 2*a*. The lamp 90 provides the light source in a miniaturized design, and includes an antenna ground plane.

Figure 2A:
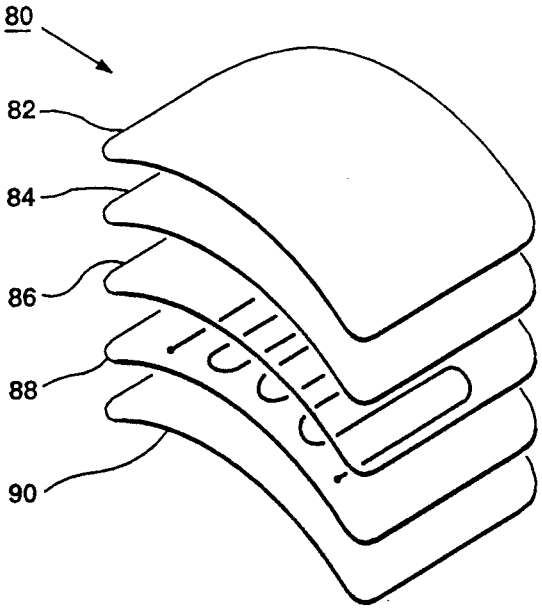
FIG. 2*a* is a schematic exploded perspective view showing a second embodiment in accordance with the present invention.

Referring to FIG. 2*a*, there is seen the details of the conformal antenna sandwich 80 in FIG. 2 consisting of five layers. The five layers illustrated are: a silicon dioxide $SiO_2$ protective coating 82 applied over a topcoat 84 for overall protection, a CdS coating on polyimide film 86, a microstrip antenna in a transparent dielectric sandwich 88, and an electro-illuminescent lamp and antenna ground plane 90 (with antenna lead pass-throughs). The ground plane has leads passing through to the associated subsystems within the vehicle.

Figure 3:
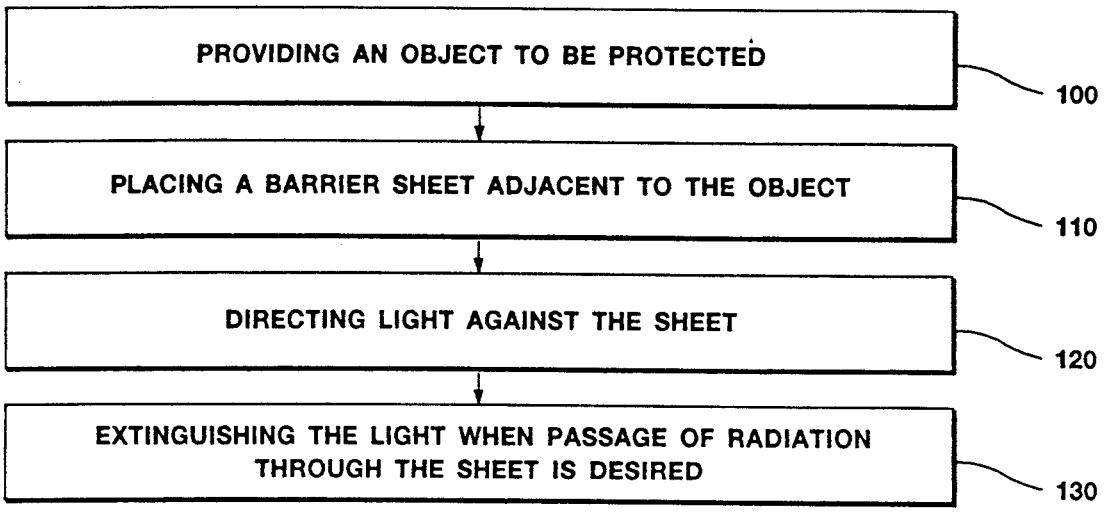
FIG. 3 is a block diagram illustrating the method of providing a photoresistive coating.

Referring to FIG. 3, there is seen a block diagram which substantially illustrates the steps to the method of this invention of applying the photoresistive coating.

The first step, as indicated in box 100, is providing an object to be protected from electromagnetic radiation.

The second step, as indicated in box 110, is placing a barrier sheet adjacent to the object. This sheet is opaque to the radiation when exposed to light.

Then the next step, as indicated in box 120, is directing the light against the sheet when a barrier to the radiation is desired.

The last step, as indicated in box 130, is extinguishing the light when passage of the radiation through the sheet is desired.

Figure 4:
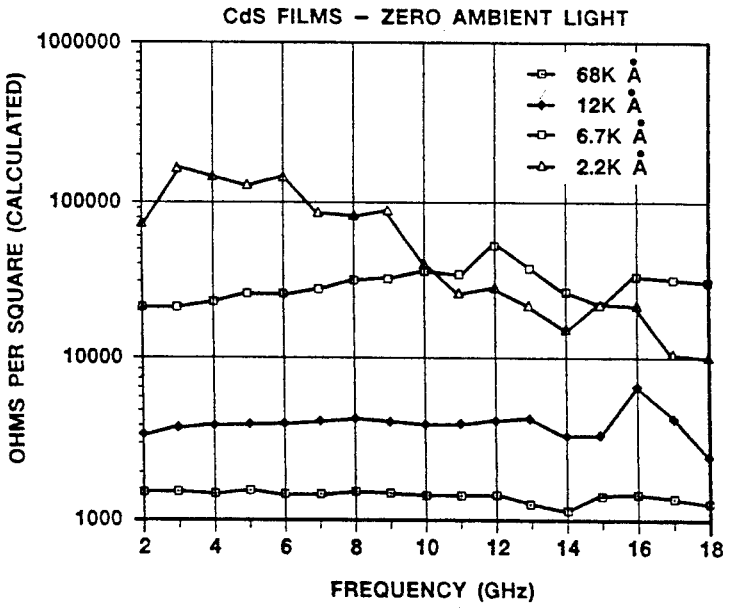
FIG. 4 is a graph diagram illustrating resistivity data for several grades of CdS in the absence of light.

Referring to FIG. 4, there is seen a graph diagram illustrating resistivity data for several thicknesses of CdS coating in the absence of light. When the lamp or other light source is in the off position, the CdS resistance is high, thereby opening the aperture. The data seem to show that for coating thicknesses of 6.7K angstroms, the resistance decreases with increased frequency. However, for thicknesses of 68K, 12K and 2.2K angstroms, the resistance appears independent of frequency within the tested range, 2–18 GHz. However, at 12K angstroms, a perturbation at 16K GHz exists.

Figure 5:
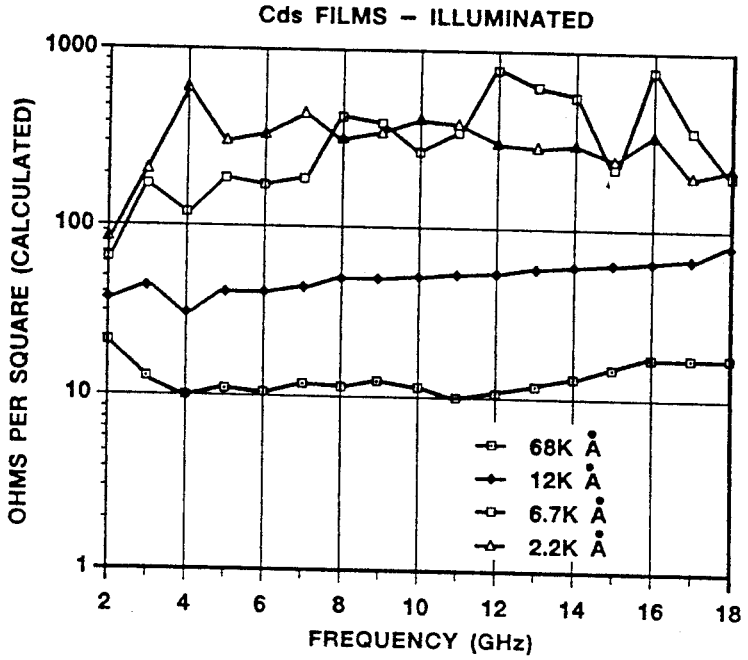
FIG. 5 is a graph diagram illustrating resistivity data for several grades of CdS in the presence of light.

Referring to FIG. 5, there is seen a graph diagram illustrating resistivity data for several thicknesses of CdS coating in the presence of light. When the lamp or other light source is in the on position, the CdS resistance is low, thereby closing the aperture. The data seem to show that for coating thicknesses of 6.7K angstroms, the resistance increases erratically with increased frequency. This result is opposite from the case without illumination. However, for thicknesses of 68K and 2.2K angstroms, the results appear the same; that is, the resistance appears independent of frequency within the tested range, 2–18 GHz. However, at 12K angstroms, a gradual increase in resistance occurs as frequency increases, rather than an essentially constant resistance without illumination.

Figure 6:
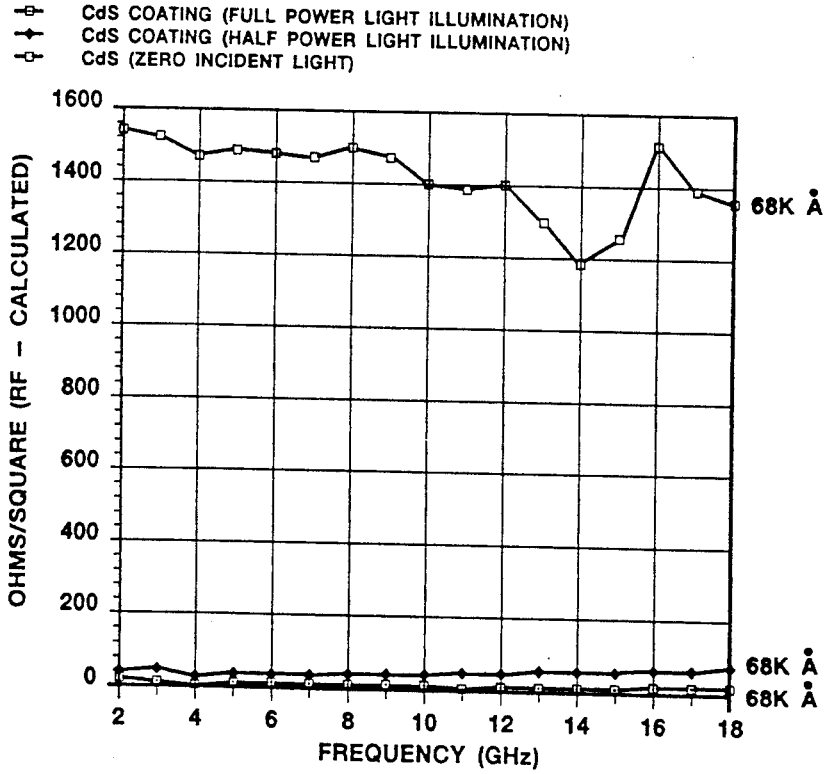
FIG. 6 is a graph diagram illustrating the effect of RF surface resistivity of CdS as a function of incident light illumination.

Referring to FIG. 6, there is seen a graph diagram illustrating the effect of RF surface resistivity of CdS as a function of incident light illumination. This graph shows even more dramatically than FIG. 4 or FIG. 5 the effect of light on resistivity of a CdS coating. Zero incident, or the absence of light, provides the resistance.

It can be seen that the present invention provides a novel method and apparatus which provides a breakthrough in applying the characteristics of photoconductivity.

The foregoing description of the invention is explanatory thereof and various changes in the size, shape and materials, as well as on the details of the illustrated construction may be made, within the scope of the appended claims without departing from the spirit of the invention.

What is claimed is:

1. A method of protecting an object against electromagnetic radiation, which comprises the steps of:

providing an object to be protected from electromagnetic radiation;

placing a barrier sheet adjacent to said object, said sheet including a layer of a photoresistive material which is opaque to said radiation when exposed to visible light;

directing said light against said sheet when a barrier to said radiation is desired; and extinguishing said light when passage of said radiation through said sheet is desired.

2. A switchable electromagnetic radiation barrier system, which comprises:

a photoresistive sheet interposed between a source of electromagnetic radiation and an object to be protected from said radiation;

said sheet including a layer of a photoresistive material which is transparent to said radiation in the absence of light and opaque to said radiation when exposed to visible light;

a light source in approximate vicinity to said sheet adapted to direct said light against said sheet; and means for turning said light source off and on.

3. The apparatus according to claim 2, wherein said radiation has a range of frequencies from approximately 2–18 GHz.

4. The apparatus according to claim 2, wherein said sheet is a polyimide film of thickness 0.002 inches (0.005 centimeters).

5. The apparatus according to claim 2, wherein said layer of a photoresistive material is from about 50,000 to 100,000 angstroms thick.

6. The photoresistive material coating according to claim 5, wherein said layer is a coating applied to a first side of said polyimide film, said first side being exposed to said light source.

7. The apparatus according to claim 2, wherein said photoresistive material layer comprises a chemical compound selected from the group consisting of:

Cadmium Sulfide, Cadmium Selenide, Tellurium Sulfide, Tellurium Selenide, Lead Indium, Zinc Sulfide, Zinc Selenide, Zinc Telluride, Lead Sulfide, Lead Selenide, Lead Telluride, and mixtures thereof.

8. The apparatus according to claim 2, wherein said sheet further carries a protective coating comprising $SiO_2$.

9. Apparatus for protecting an electromagnetic interference (EMI) sensitive device in an air vehicle from external electromagnetic radiation (EMR) which comprises:

a cavity in an air vehicle;

an EMI-sensitive device in said cavity;

a barrier window covering said cavity;

said window comprising a support sheet having a photoresistive material coating thereon;

said material coating transmitting EMR when exposed to light and not transmitting EMR when unlighted;

a light source adapted to selectively illuminate said coating; and switchable means to turn said light off and on.

10. The apparatus according to claim 9, wherein said light source is a fluorescent lamp.

11. The apparatus according to claim 9, wherein said light source power is approximately 30 watts.

12. The apparatus according to claim 9, wherein said photoresistive material coating comprises a chemical compound selected from the group consisting of:

Cadmium Sulfide, Cadmium Selenide, Tellurium Sulfide, Tellurium Selenide, Lead Indium, Zinc Sulfide, Zinc Selenide, Zinc Telluride, Lead Sulfide, Lead Selenide, Lead Telluride and mixtures thereof.

13. The apparatus according to claim 9, wherein said photosensitive material coating further carries a protective coating comprising $SiO_2$.

14. An antenna of layered sandwich construction, which comprises:

a thin film electro-illuminescent solid state lamp and antenna ground plane layer;

a transparent dielectric sandwich layer;

a polyimide film layer with a photoresistive material coating;

a polyurethane topcoat layer; and a protective SiO2 coating layer.

15. The apparatus according to claim 14, wherein said photoresistive material coating has a thickness about 50,000 to 100,000 angstroms.

16. The apparatus according to claim 14, wherein said photoresistive material coating is applied to the side of said polyimide film adjacent to said lamp.

17. The apparatus according to claim 14, wherein said photoresistive material coating comprises a chemical compound selected from the group consisting of:

Cadmium Sulfide, Cadmium Selenide, Tellurium Sulfide, Tellurium Selenide, Lead Indium, Zinc Sulfide, Zinc Selenide, Zinc Telluride, Lead Sulfide, Lead Selenide, Lead Telluride, and mixtures thereof.

18. The apparatus according to claim 14, wherein said transparent dielectric sandwich layer includes a microstrip antenna.

* * * * *